US009350131B2

(12) United States Patent
Beck et al.

(10) Patent No.: US 9,350,131 B2
(45) Date of Patent: May 24, 2016

(54) CONTACT PIN, CONNECTOR COMPRISING A CONTACT PIN AND METHOD FOR MANUFACTURING A CONTACT PIN

(71) Applicant: Tyco Electronics AMP GmbH, Bensheim (DE)

(72) Inventors: Karl Beck, Langen (DE); Heinrich Romuald Schmidt, Langen (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/390,390

(22) PCT Filed: Mar. 21, 2013

(86) PCT No.: PCT/EP2013/055932
§ 371 (c)(1),
(2) Date: Oct. 2, 2014

(87) PCT Pub. No.: WO2013/149843
PCT Pub. Date: Oct. 10, 2013

(65) Prior Publication Data

US 2015/0044916 A1 Feb. 12, 2015

(30) Foreign Application Priority Data

Apr. 3, 2012 (DE) ..... 10 2012 102 904

(51) Int. Cl.
*H01R 43/16* (2006.01)
*H01R 12/58* (2011.01)
(Continued)

(52) U.S. Cl.
CPC ..... *H01R 43/16* (2013.01); *H01R 12/585* (2013.01); *H01R 13/057* (2013.01); *H01R 13/20* (2013.01); *H01R 12/724* (2013.01); *Y10T 29/49204* (2015.01)

(58) Field of Classification Search
CPC ..... H01R 43/16
See application file for complete search history.

(56) References Cited

U.S. PATENT DOCUMENTS 3,560,911 A * 2/1971 Zimmerman, Jr. et al. ... 439/848
4,684,203 A 8/1987 Bihler
(Continued)

FOREIGN PATENT DOCUMENTS

CN 1236206 A 11/1999
CN 1026275 A 8/2007
(Continued)

OTHER PUBLICATIONS

International Search Report and Written Opinion issued by the European Patent Office, dated Apr. 19, 2013, for International Application No. PCT/EP2013/055932; 9 pages.
(Continued)

*Primary Examiner* — James Harvey
(74) *Attorney, Agent, or Firm* — Faegre Baker Daniels LLP

(57) ABSTRACT

A contact pin is disclosed with first and second end portions and a bending portion located therebetween, wherein the cross section of at least one end portion has a preferred bending direction (V1) and at least one bending resistance direction (R1) and wherein the moment of inertia of the cross section of the at least one end portion is smaller in the preferred bending direction than in the bending resistance direction. If such contact pins are bent perpendicular to their longitudinal extension (Z) by a bending force in one direction (F), then the direction of the actual bending (X) deviates from the direction of the bending force. In order to eliminate this deviation, the difference between the moments of inertia in the preferred bending direction and in the bending resistance direction in the cross section of the bending portion is smaller than in the at least one end portion.

20 Claims, 8 Drawing Sheets

(51) Int. Cl.

| | |
|---|---|
| ***H01R 13/05*** | (2006.01) |
| ***H01R 13/20*** | (2006.01) |
| *H01R 12/72* | (2011.01) |

(56) References Cited

U.S. PATENT DOCUMENTS

| | | | | |
|---|---|---|---|---|
| 5,133,847 | A * | 7/1992 | Boyd | 204/198 |
| 5,575,666 | A * | 11/1996 | Dent | 439/82 |
| 6,126,496 | A | 10/2000 | Shinozaki | |
| 6,406,338 | B1 * | 6/2002 | Endo et al. | 439/885 |
| 6,575,773 | B1 * | 6/2003 | Takeuchi | 439/79 |
| 6,748,787 | B1 * | 6/2004 | Liu | 72/379.2 |
| 7,357,670 | B2 | 4/2008 | Tanaka | |
| 2001/0006854 | A1 * | 7/2001 | Moriwake et al. | 439/78 |
| 2002/0173180 | A1 | 11/2002 | Saito | |
| 2004/0115971 | A1 * | 6/2004 | Nose et al. | 439/79 |
| 2006/0040568 | A1 * | 2/2006 | Sasaki et al. | 439/752 |
| 2006/0172624 | A1 * | 8/2006 | Matsuoka et al. | 439/884 |
| 2012/0058692 | A1 * | 3/2012 | Huang et al. | 439/886 |
| 2012/0115339 | A1 * | 5/2012 | Schaarschmidt et al. | 439/66 |
| 2015/0044916 | A1 * | 2/2015 | Beck et al. | 439/733.1 |

FOREIGN PATENT DOCUMENTS

| | | |
|---|---|---|
| EP | 1083629 A2 | 3/2001 |
| JP | 1116644 A | 4/1999 |

OTHER PUBLICATIONS

English Translation of the Office Action dated Mar. 3, 2016 in Chinese Patent Application No. 201380016868.4; 9 pages.

* cited by examiner

CONTACT PIN, CONNECTOR COMPRISING A CONTACT PIN AND METHOD FOR MANUFACTURING A CONTACT PIN

BACKGROUND

The invention relates to a contact pin with a first and a second end portion and a bending portion located between the end portions, the cross section of at least one end portion having a preferred bending direction and at least one bending resistance direction and the moment of inertia of the cross section of the at least one end portion, being smaller in the preferred bending direction than in the bending resistance direction. The invention also relates to a connector with a contact pin of this type. Furthermore, the invention relates to a method for manufacturing such a contact pin.

Contact pins are used in many fields of electrical equipment and electronics. Usually, contact pins with polygonal, usually substantially rectangular cross sections are used in these fields. In many applications these contact pins must be bent at a bending portion, which is located between two end portions. In a preferred bending direction perpendicular to the longitudinal extension of the contact pin and perpendicular to a preferred bending axis, which is perpendicular to the longitudinal extension of the contact pin, bending is relatively easy. Along at least one bending resistance direction perpendicular to the longitudinal extension of the contact pin and perpendicular to a bending resistance axis, which is perpendicular to the longitudinal extension of the contact pin, bending is more difficult. A measurement of how difficult or easy the contact pin can be bent along a bending direction is the moment of inertia, especially the axial moment of inertia, in the bending direction or bending axis respectively. The moment of inertia for a bending axis is defined as the integral over the square of the distance of a point to the bending axis integrated over the cross-sectional area. If the moment of inertia relating to a bending axis or a bending direction, which direction is perpendicular to the bending axis and perpendicular to the longitudinal extension of the contact pin, is high then bending about this axis or in this direction is difficult.

Contact pins are often inserted into pin sockets with a complementary form and then bent over an edge. Due to production tolerances, however, the contact pin and socket do not usually fit together precisely, so that the contact pin twists about its longitudinal axis when it is received into the socket and is locked. If in a subsequent stage a bending force is exerted onto the contact pin, this does not act along the preferred bending direction but in a different direction. The contact pin deflects towards the preferred bending direction when it is bent so that the contact pin is not bent along the direction of the bending force but rather in a different direction. The direction of the contact pin must then be corrected in an additional step, which leads to a high outlay in production.

The problem addressed by the present invention is to provide a contact pin, the processing of which does not require such an additional corrective step.

SUMMARY

This is achieved according to the invention with a contact pin in which the difference between the moments of inertia in the preferred bending direction and in the bending resistance direction in the cross section of the bending portion is smaller than in the at least one end portion. By means of the solution according to the invention the contact pin acts with the bending force better and more accurately when the bending portion is bent. Thereby an additional corrective step to align the contact pin after the bending process can be avoided.

The solution according to the invention can be improved in accordance with the following developments, each of which is advantageous and freely combinable.

The bending portion can be arranged differently in comparison to the at least one end portion. It can have a different cross section, i.e. a different cross-sectional shape and/or a different cross-sectional area.

The preferred bending direction can be the direction in the cross-sectional plane, which has the smallest moment of inertia.

The bending resistance direction can be the direction in the cross-sectional plane, which has the largest moment of inertia.

The at least one end portion, can have more than one bending resistance direction. For example, an end portion with a rectangular cross section can have four bending resistance directions, which each extend from the centre of the rectangle to a corner. The values of the associated moments of inertia for bending along the different bending resistance directions can be equal or different. In particular, in the cross section of the bending portion the difference between the moment of inertia in the preferred bending direction and the bending resistance direction with the largest moment of inertia can be smaller than in the at least one end portion.

In a preferred embodiment the moment of inertia in the bending portion in the direction transverse to the longitudinal extension of the contact pin is constant. The longitudinal extension of the contact pin can be the longitudinal axis in the case of a straight or bent contact pin.

In another embodiment, the moment of inertia in the bending portion transverse to the longitudinal extension of an end portion is constant. In both cases if there is a plurality of bending resistance directions it can be sufficient for the moment of inertia to be constant in the direction transverse to the longitudinal extension of the contact pin in the region between the bending resistance directions.

The cross section of the bending portion can be circular. In such an embodiment the bending portion can be bent in any direction. The preferred bending direction can therefore comprise all directions, which extend transverse to the longitudinal extension. The difference in the moments of inertia between the preferred bending direction and the bending resistance direction can be zero or nearly zero. The preferred bending direction can match with the bending resistance direction. In the case of a circular embodiment of the cross section the actual bend can follow the bending force exactly. A correction of the direction of the contact pin can therefore become totally superfluous.

It can also be sufficient for the cross section of the bending portion of the contact pin to be only partially curved. For example, the bending portion can be curved on only one longitudinal side. Alternatively or additionally, the cross section can have a circle-segment, for example semi-circular, contour, at least in places. There can be angles on the rest of the contour or the circle-segment can be closed with a straight line. Alternatively or additionally, the cross section in the bending portion can have regions in which the contour is curved. These curved portions do not have to extend like a circle-segment, but can also have other forms. For example, they can be partly elliptical, parabolic or extend along a curve of a polynomial function. The cross section of the bending portion can have convex outer contours, meaning that in the region between two points the distance to the centre is greater than at the two points.

The at least one end portion, can have a polygonal cross section. For example, the end portion can have a rectangular, preferably square cross section. In particular, the end portion can have a cross section, which is substantially square but has rounded corners. The cross section can also be polygonal only in part. In this way, one side can have angles whereas another side is curved.

Between the at least one end portion, and the bending portion there can be a junction portion, where the cross section of the end portion joins the cross section of the bending portion. This junction portion can be stepped. Alternatively, the junction between the end portion and bending portion can be fluent, meaning that the junction portion does not have any steps or edges.

In a preferred embodiment the difference between the moments of inertia in the preferred bending direction and in the bending resistance direction in the cross section of the bending portion is smaller than in the two end portions. The second end portion can have the same preferred cross sections as the first end portion. In particular the second end portion can have the same cross section as the first end portion. It can therefore have the same cross-sectional shape, size and/or area. In particular, the cross section of the second end portion can have the same alignment as the cross section of the first end portion, at least in the non-bent state. If, for example, both end portions have a square cross section, then the two squares can be superimposed congruently in the unbent state, when viewed along the longitudinal extension of the contact pin. In the bent state the two squares can, however, be twisted against each other. Alternatively, cross sections with the same form with the same cross-sectional areas can be orientated differently. For example, both end portions can have a square cross section with the corners of the squares in the two end portions pointing in different directions.

The bending section can be produced by means of cross-sectional reshaping. For example, an already existing bending portion can be reshaped so that the contact pin becomes a contact pin according to the invention. Alternatively, the bending portion can originate only through a reshaping of the cross section, for example another portion, which was originally not a bending portion, can be reshaped into a bending portion. Thus a contact pin, which has a first and a second end portion, can be reshaped into a contact pin according to the invention in that parts of the first and/or second end portions are reshaped into a bending portion. This is possible by means of cross-sectional reshaping. In a preferred embodiment, a contact pin with two end portions, which each have a polygonal cross section, is reshaped into a contact pin according to the invention in that parts of the first or second end portion are reshaped into a curved, preferably circular cross section.

Cross-sectional reshaping is possible, for example, by means of compression. The cross-sectional reshaping process can in particular be a cold-forming process. The cross section can be reshaped in the process simply by exerting pressure without an increase in temperature. This can, for example, occur with the aid of a die or mould, which predetermines the future cross section. Free reshaping without a set mould is also possible. Reshaping by means of rolling in the longitudinal or transverse direction is also possible. In any case the length of the contact pin can change as a result of the reshaping process; in particular the contact pin can lengthen as a result. The cross-sectional area in the bending portion can change as a result of the reshaping process; in particular the cross section can become smaller. Reshaping, which only changes the cross-sectional shape but not the cross-sectional area, is also possible. In this case the contact pin cannot lengthen.

In a preferred embodiment a contact pin has a first and a second end portion before the reshaping process, which each have the same cross-sectional shape and area.

During reshaping of the bending portion an end portion can also be reshaped at the same time. In particular, at least one end portion can be reshaped at least in part into a bending portion. The length of the reshaped end portion can change as a result.

A contact pin can have a plurality of bending portions, in particular a plurality of bending portions according to the invention.

A contact pin can have additional functional portions. For example, there can be junction portions between the end portions and the bending portion.

A contact pin according to the invention can be bent in the bending portion. In this way the two end portions can extend in different directions. The two directions can intersect in particular at one point. A contact pin according to the invention can be arranged inside a connector. In particular, the first end portion can be inserted positively into a pin socket with a complementary cross-sectional form. The first end portion can be arranged completely or just in part inside the socket. A positive lock can only act transverse to the longitudinal extension of the inserted end portion, so that the contact pin can be moved along the longitudinal extension of the inserted end portion.

A connector can have various contact pins according to the invention. For example, there can be various contact pins, which each have the same cross section in at least one end portion and the bending portion but have different lengths. Thus the ends of the contact pins can lie in the same plane in the bent state.

Examples of advantageous embodiments of the invention are described in the following with reference to the drawings. The described embodiments only represent possible embodiments, in which, however, the individual characteristics as described above can be combined independently of one another or omitted. The same reference numerals in the various drawings each denote the same objects.

DETAILED DESCRIPTION OF THE DRAWINGS

Figure 1A:
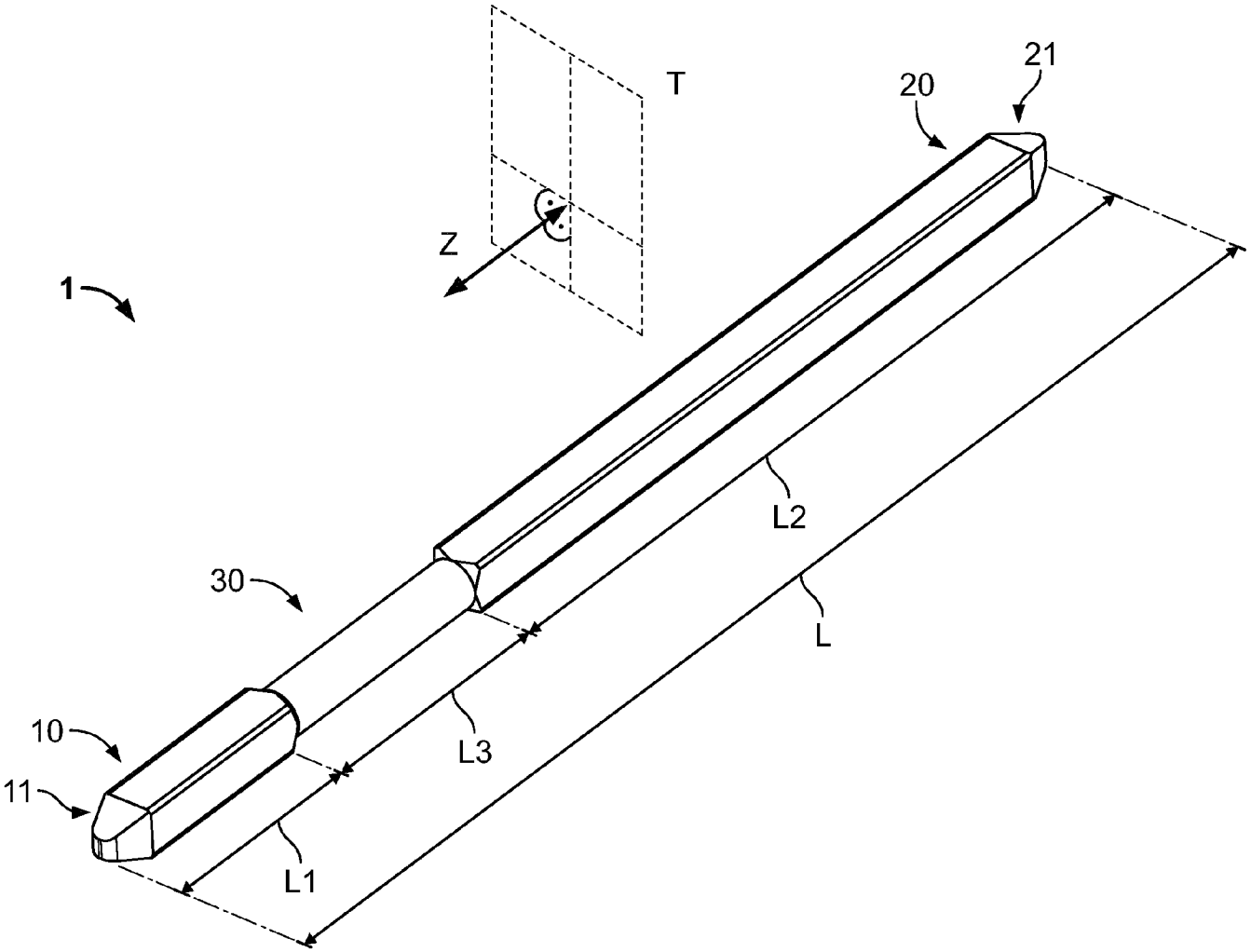
FIG. 1A is a schematic perspective view of a first embodiment of a contact pin according to the invention.

In FIG. 1A a contact pin 1 according to the invention is shown. It has a first end portion 10 and a second end portion 20 as well as a bending portion 30 located between the first end portion 10 and the second end portion 20. The length L1 of the first end portion 10 in the direction of the longitudinal extension Z of the contact pin 1 is smaller than the corresponding length L2 of the second end portion 20. The length L3 of the bending portion 30 is independent of the lengths of the two end portions L1, L2. In this case the length L3 of the bending portion 30 is about 20% of the total length L of the contact pin 1 in the direction of the longitudinal extension Z. The length L3 of the bending section 30 can, however, differ from this value and be adapted to the respective intended purpose.

In this case the length L of the contact pin 1 is made up of the lengths L1, L2, L3 of the first end portion 10, the second end portion 20 and the bending portion 30. In alternative embodiments there can be additional portions as well as the two end portions 10, 20 and the bending portion 30. In particular, there can be additional bending portions, for example a second bending portion according to the invention.

The end portions 10, 20 shown here both have insertion portions 11, 21, in which the end portions taper in order to facilitate insertion into a pin socket.

The cross sections of the first end portion 10 and of the second end portion 20 in a cross-sectional plane T, which extends perpendicular to the longitudinal extension Z of the contact pin, are the same. In this case they have the same shape, area and orientation.

Figure 1B:
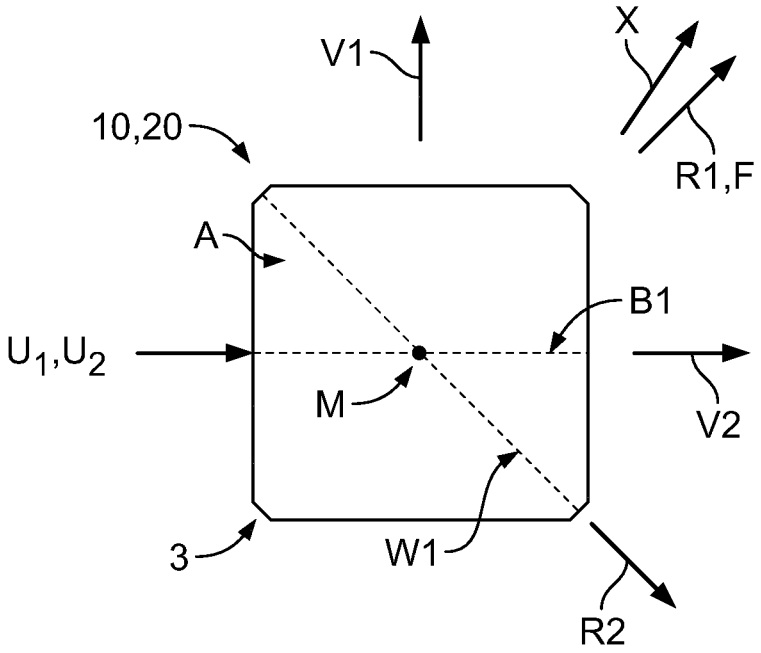
FIG. 1B is a schematic cross section through an end portion of the contact pin shown in FIG. 1A along a transverse plane perpendicular to the longitudinal extension of the contact pin.

In FIG. 1B such a cross section of the first and second portion 10, 20 is shown. The outer contour U1, U2 is substantially square but has chamfered corners 3. The contour U1, U2 is therefore polygonal, in this case octagonal. The corners can also be rounded. The end portion shown 10, 20 has a first preferred bending direction V1 and a second preferred bending direction V2. The end portion 10, 20 can be bent along and against these preferred bending directions V1, V2 with the slightest resistance. In the process bending occurs about a bending axis B1 in the direction of the preferred bending direction V1. The moment of inertia, in particular the axial moment of inertia, about this bending axis B1 is smaller than in other directions, which deviate slightly from the preferred direction V1. In the example shown here the preferred bending direction V1 represents the bending direction with the smallest moment of inertia. The moment of inertia is, as is customary, defined as the surface integral over area A of the cross section over the square of the distance from the bending axis, the bending axis extending through the central point M of the area A.

In the case of the cross section shown here there is still a second preferred bending direction V2, along which bending is just as easy as along the preferred bending direction V1.

Furthermore, the end portion 10, 20 shown has a bending resistance direction R1, in which direction bending is difficult; the moment of inertia relating to the bending resistance direction R1 and relating to bending axis W1 belonging to the bending resistance direction R1 is increased here. The end portion 10, 20 shown here has a plurality of bending resistance directions, for example a second bending resistance direction R2 is drawn in. In the case of the symmetrical embodiment shown here the moment of inertia relating to bending along the second bending resistance direction R2 is equal to the moment of inertia relating to bending along the bending resistance direction R1.

If an attempt is made to bend the end portion 10, 20 along a bending resistance direction R1, that is to say with a bending force F, which points in the direction of the bending resistance direction R1, then even small deviations lead to the bending not taking place along direction R1, but rather along a direction X of actual bending, which is turned towards a preferred bending direction V1.

Figure 1C:
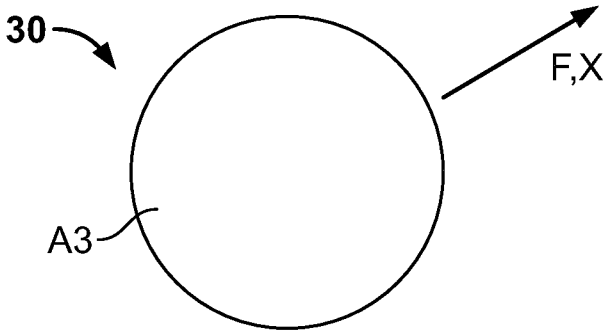
FIG. 1C is a schematic cross section through a bending portion of the contact pin shown in FIG. 1A along a transverse plane perpendicular to the longitudinal extension of the contact pin.

In FIG. 1C a cross section of the bending portion 30 of the contact pin 1 shown in FIG. 1 is shown. In this case the cross section is circular. The bending portion 30 has the same bending resistance along all directions, which are located in this cross-sectional plane, that is to say the moments of inertia relating to all directions in the cross-sectional plane are equal. At the same time all directions are bending resistance directions R1. The difference in the moments of inertia relating to the preferred bending direction V1 and the bending resistance direction R1 is therefore zero. In the case of the circular embodiment of the bending portion 30 shown here, a bending force F in any direction which is in the cross-sectional plane leads to bending in this bending direction. The direction X of the actual bending therefore matches with the direction of the bending force F. The bending portion 30 with a circular profile shown in FIGS. 1A and 1C can be produced from another cross section by reshaping. For example, a bending portion 30 with a cross section, which resembles the cross section of the end portions 10, 20, can be reshaped into a cross section according to the invention. This can, for example, be carried out through rolling or compression. As a result of this reshaping process the length L of the contact pin 1 can change depending on the reshaping process or even remain the same. In particular, therefore, the area A3 of the bending portion 30 shown in FIG. 10 can be the same as area A of the first and/or second end portion 10, 20.

Figure 2:
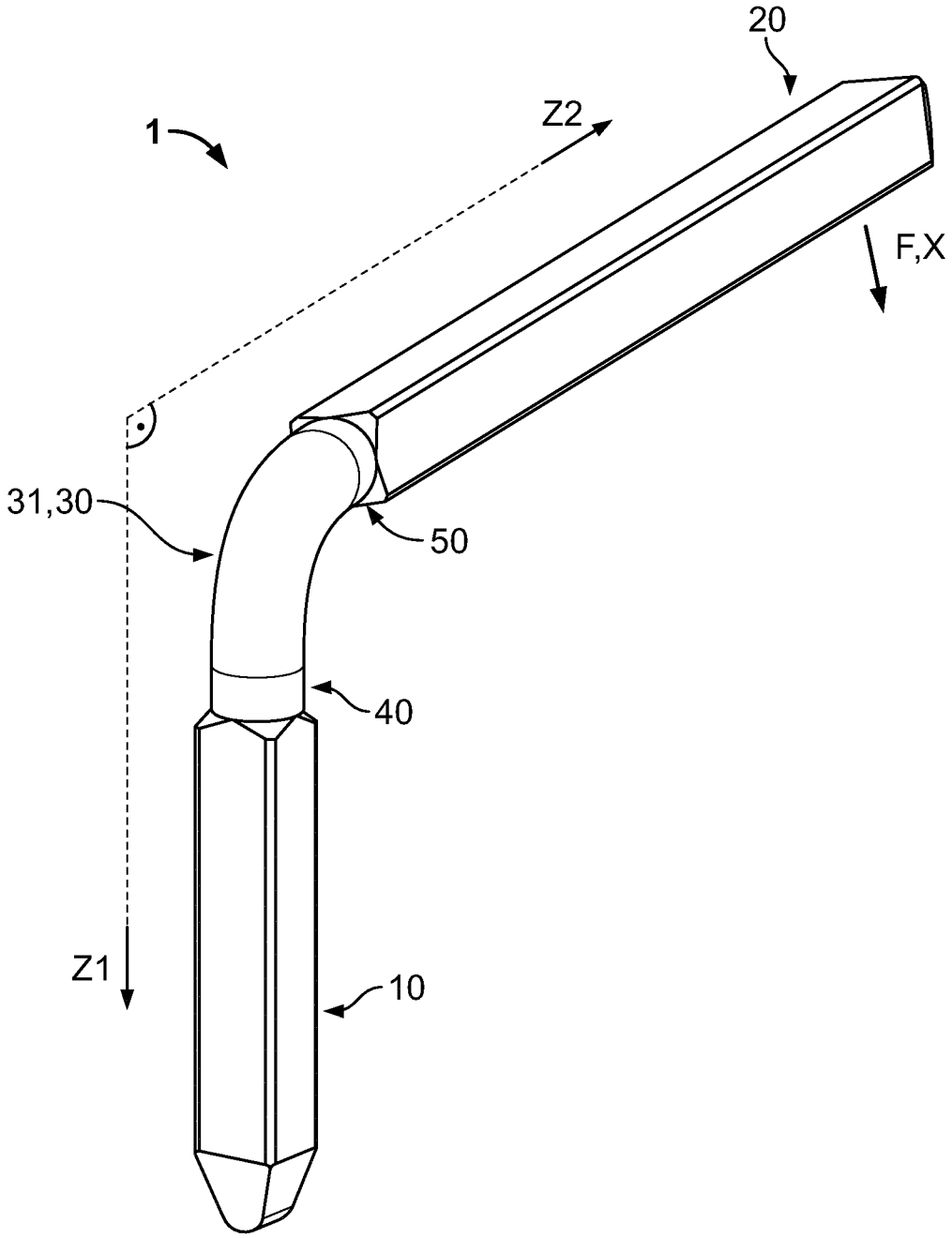
FIG. 2 is a schematic perspective view of a second embodiment of a contact pin according to the invention.

In FIG. 2 a second embodiment of a contact pin 1 according to the invention is shown. This contact pin 1 again has a first end portion 10, a second end portion 20 and a bending portion 30 located between the two end portions 10, 20. The contact pin 1 shown here is already bent at the bending portion 30. The direction of the longitudinal extension Z1 of the first end portion 10 is different to the direction of the longitudinal extension Z2 of the second end portion 20. The two directions Z1, Z2 of the longitudinal extensions intersect at a point and in this example form an angle of about 90°. The cross sections of the first and second end portions 10, 20 in a plane, which is perpendicular to the longitudinal extension directions Z1, Z2, are similar to the cross section shown in FIG. 1B.

The bending portion 30 has a cross section through the curvature 31, which deviates from a circle. In a junction portion 40, which is located between the bending portion 30 and the first end portion 10, the cross section is still almost circular. Further on at the centre of the bending portion 30 the deviation from the circular form can be greater. In a second junction portion 50, which is located between the bending portion 30 and the second end portion 20, the cross section is almost circular again.

The contact pin 1 shown here can be produced by bending a straight contact pin 1. For example, a bending force F may have been exerted. Thanks to the circular bending portion 30 this force F leads to bending in the direction of the bending force F. The actual bending direction X therefore matches with the direction of the bending force F.

Figure 3:
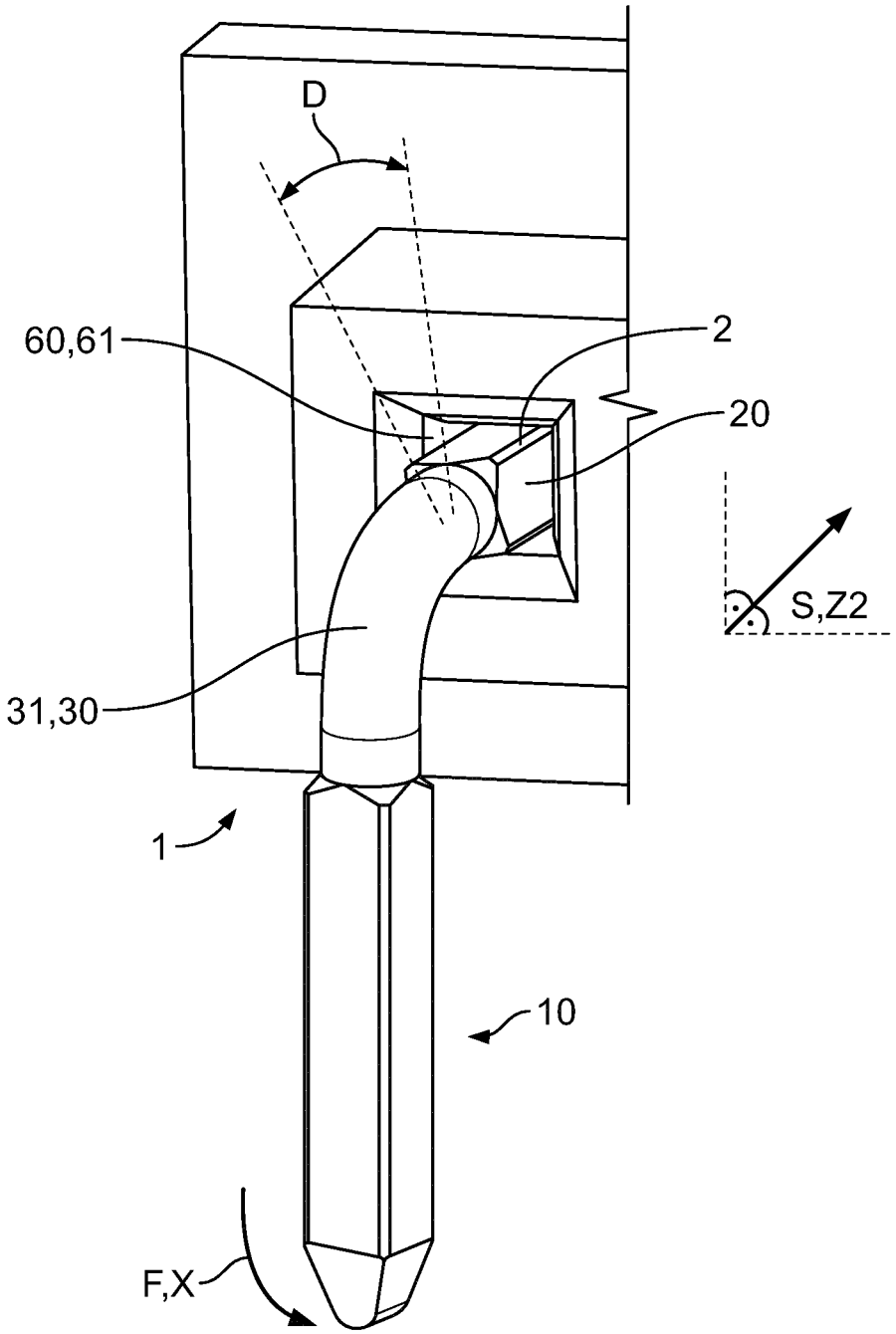
FIG. 3 is a schematic perspective view of a contact pin according to the invention in a pin socket.

In FIG. 3 a contact pin 1 according to the invention is shown inserted into a pin socket 60. The pin socket 60 can for example be part of a connector 70, which can also have additional pin sockets 60 and additional contact pins 1. The first end portion 10 and the second end portion 20 again have a polygonal cross section, which is substantially square, but has chamfered edges 2. Between the first end portion and the second end portion 20 there is a bending portion 30, which has a curvature 31. The two end portions 10, 20 therefore extend in different spatial directions.

The pin socket 60 of the connector 70 has a cross section complementary to the second end portion 20. The inner contour 61 of the pin socket 60 has a substantially square cross section.

The contact pin 1 can be inserted into the connector socket 60 along an insertion direction S, which extends perpendicular to the surface of the connector.

The contact pin 1 shown was produced by bending a straight contact pin 1 according to the invention. During the bending process the contact pin 1 was inside the pin socket 60. Despite the arrangement of the outer contour of the contact pin and the inner contour 61 of the pin socket 60 with complementary cross sections, the contact pin 1 can be rotated slightly about the direction of the longitudinal extension Z2 of the second end portion 20, meaning in a rotation direction T. As a result of the circular configuration of the cross section of the bending portion 30 such a rotation inside the pin socket 60 does not, however, lead to the actual bending direction X deviating from the direction of the bending force F. Both directions F, X are therefore located on top of each other. An additional alignment stage to correct the alignment of the end portion 10 is omitted in the case of such an embodiment.

Figure 4:
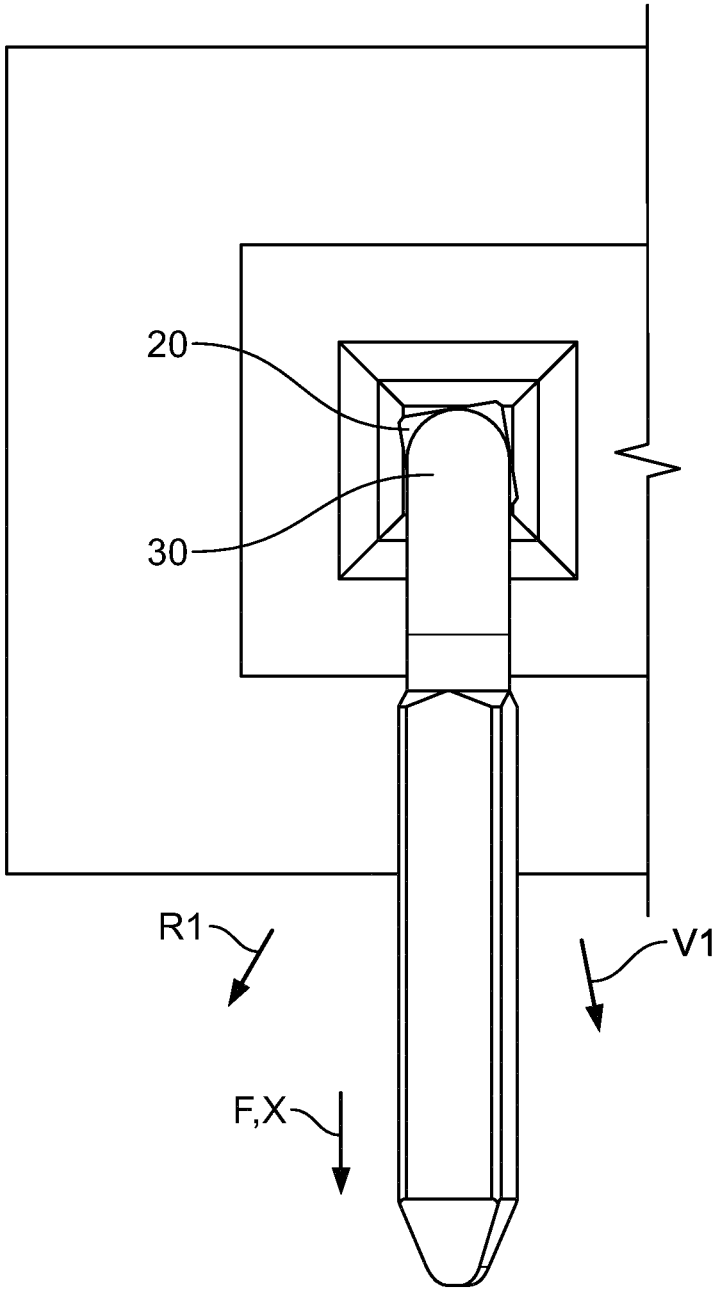
FIG. 4 is a schematic front view of the contact pin and the pin socket shown in FIG. 3.

In FIG. 4 the contact pin 1 and pin socket 60 shown in FIG. 3 are shown in a front view.

The second end portion 20 is twisted and locked in the pin socket 60. Although the direction of the bending force F differs from the preferred bending direction V1 and has an element in the direction of a bending resistance direction R1, the direction of the actual bending X is in the direction of the bending force F. This is due to the circular cross section of the bending portion 30. If the bending portion 30 had the same cross section as the second end portion 20, then a bending force F, which is not ideally located in a preferred bending direction V1 but rather has elements along a bending resistance direction R1, would lead to an actual bending, the direction X of which differs from the direction of the bending force F.

Figure 5:
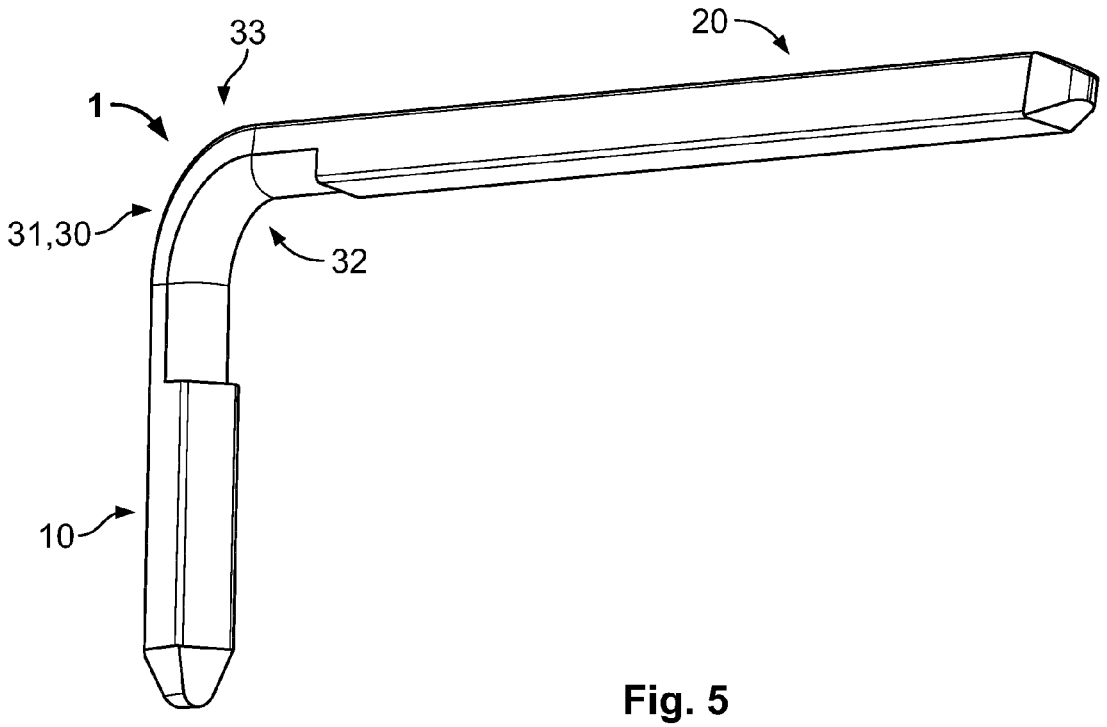
FIG. 5 is a schematic perspective view of a third embodiment of a contact pin according to the invention.
Figure 6:
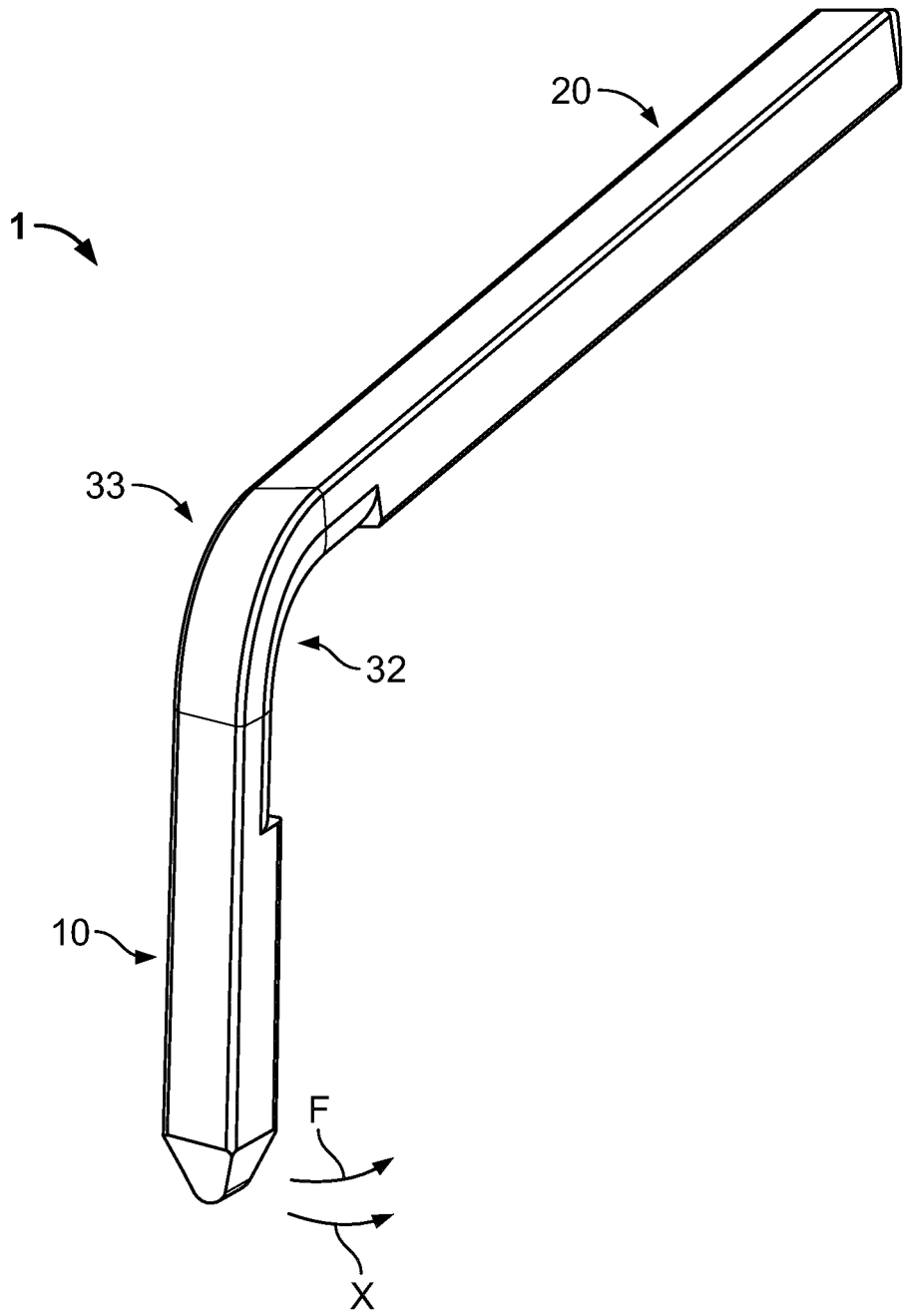
FIG. 6 is a schematic perspective view of the contact pin shown in FIG. 5 from a different line of vision.

In FIGS. 5 and 6 a third embodiment of a contact pin 1 according to the invention is shown. Between a first end portion 10 and a second end portion 20 there is again a bending portion 30. The bending portion 30 shown here, however, does not have a circular cross section like the examples shown so far, but rather only has a cross section which is curved in part. This leads to a bending force in direction F leading to a bending along a direction X, which only differs slightly from the direction of the bending force F. The direction of the bending force F and the actual bending direction X therefore do not match exactly, although they are located closer together than in the case of a contact pin 1, which has the same cross section in its bending section 30 as in the first end portion 10 and in the second end portion 20. The direction of the bending force F and the actual bending direction X can be so close together that an additional corrective step to correct the alignment of the bent contact pin 1 is not necessary.

The cross section of the bending portion 30 is curved on an inner side 32. On an outer side 33 it has a plurality of angles.

In FIG. 6 the contact pin 1 shown in FIG. 5 is shown again from another perspective. The angular configuration on the outer side 33 and the curved configuration on the inner side 32 make it easier to bend the first end portion 10 towards the second end portion 20. The direction of the actual bending X is therefore close to the direction of the bending force F.

Figure 7:
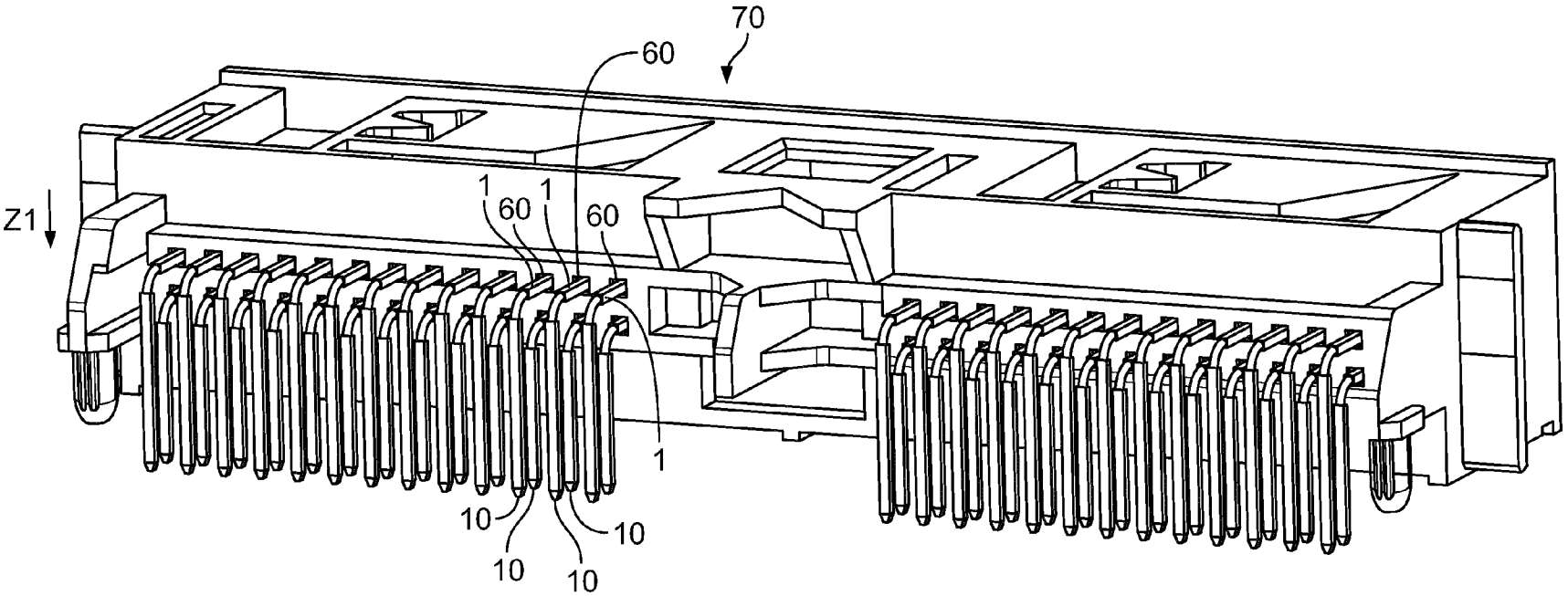
FIG. 7 is a schematic perspective view of a connector according to the invention.

In FIG. 7 a connector 70 according to the invention is shown. The connector 70 comprises a plurality of pin sockets 60, into which the contact pins 1 according to the invention have been inserted. Because of the configuration of the contact pins 1 according to the invention the first end portions 10, which extend out of the connector, all point in the same direction Z1. The individual end portions 10 of the various contact pins 1 are of different lengths so that all the contact pins 1 end in one plane.

The invention claimed is:

1. A contact pin with a first and a second end portion and a bending portion located between the end portions, wherein the cross section of at least one end portion has a preferred bending direction (V1) and at least one bending resistance direction (R1) and wherein the moment of inertia of the cross section of the at least one end portion, is smaller in the preferred bending direction (V1) than in the bending resistance direction (R1), wherein the difference between the moments of inertia in the preferred bending direction (V1) and in the bending resistance direction (R1) in the cross section of the bending portion is smaller than in the at least one end portion, and wherein the cross section of the bending portion of the contact pin is only partially curved.

2. The contact pin according to claim 1, wherein the contact pin has an elongate bending portion.

3. The contact pin according to claim 1, wherein the bending portion continuously extends from one end portion to the other end portion.

4. The contact pin according to claim 1, wherein the at least one end portion has a polygonal cross section.

5. The contact pin according to claim 1, wherein the two end portions have the same cross section.

6. The contact pin according to claim 1, wherein the bending portion is produced by means of cross-sectional reshaping.

7. The contact pin according to claim 1, wherein the contact pin is bent at the bending portion.

8. A connector with a contact pin according to claim 1, wherein the first end portion is inserted positively into a pin socket with a complementary cross-sectional design.

9. A method for manufacturing a contact pin, which has a first and a second end portion and a bending portion located between the first and second end portions, wherein at least one end portion has a preferred bending direction (V1) and at least one bending resistance direction (R1) and wherein the moment of inertia of the at least one end portion in the preferred bending direction (V1) is smaller than in the bending resistance direction (R1), the method including a reshaping of the bending portion into a cross section which is only partially curved, where the difference between the moments of inertia in the preferred bending direction (V1) and in the bending resistance direction (R1) is smaller than in the at least one end portion.

10. The method for manufacturing a contact pin according to claim 9, wherein the contact pin is bent after reshaping.

11. The connector according to claim 8, wherein the contact pin is inserted in a rotated manner.

12. A contact pin with first and second end portions and a bending portion located between the end portions, wherein the cross section of each end portion is substantially equal in area and each end portion has a preferred bending direction (V1) and at least one bending resistance direction (R1) and wherein the moment of inertia of the cross section of the end portions, is smaller in the preferred bending direction (V1) than in the bending resistance direction (R1), wherein the difference between the moments of inertia in the preferred bending direction (V1) and in the bending resistance direction (R1) in the cross section of the bending portion is smaller than in the end portions.

13. The contact pin according to claim 12, wherein, and wherein the cross section of the bending portion of the contact pin is only partially curved.

14. The contact pin according to claim 12, wherein the contact pin has an elongate bending portion.

15. The contact pin according to claim 12, wherein the bending portion continuously extends from one end portion to the other end portion.

16. The contact pin according to claim 12, wherein at least one end portion has a polygonal cross section.

17. The contact pin according to claim 2, wherein the two end portions have the same cross section.

18. The contact pin according to claim 12, wherein the bending portion is produced by means of cross-sectional reshaping.

19. The contact pin according to claim 12, wherein the contact pin is bent at the bending portion.

20. A connector with a contact pin according to claim 12, wherein the first end portion is inserted positively into a pin socket with a complementary cross-sectional design.

* * * * *